US006558593B2

(12) United States Patent
Cassani

(10) Patent No.: US 6,558,593 B2
(45) Date of Patent: May 6, 2003

(54) METHOD FOR PRESSING CERAMIC POWDERS

(75) Inventor: Giuseppe Cassani, Imola (IT)

(73) Assignee: Sacmi - Cooperativa Meccanici Imola - Soc. Coop. A.R.L., Imola (IT)

( * ) Notice: Subject to any disclaimer, the term of this patent is extended or adjusted under 35 U.S.C. 154(b) by 0 days.

(21) Appl. No.: 09/944,169

(22) Filed: Sep. 4, 2001

(65) Prior Publication Data

US 2002/0030298 A1 Mar. 14, 2002

Related U.S. Application Data

(62) Division of application No. 09/124,036, filed on Jul. 29, 1998, now Pat. No. 6,305,925.

(30) Foreign Application Priority Data

Aug. 1, 1997 (IT) ..... RE97A0057

(51) Int. Cl.[7] ..... B28B 1/18; B06B 1/20

(52) U.S. Cl. ..... 264/69; 264/442; 264/443; 264/120

(58) Field of Search ..... 264/71, 120, 72, 264/69, 442, 443; 425/406–423

(56) References Cited

U.S. PATENT DOCUMENTS

| | | | | |
|---|---|---|---|---|
| 3,767,351 A | | 10/1973 | Blaser | |
| 3,795,464 A | | 3/1974 | Backman et al. | |
| 3,813,527 A | | 5/1974 | Langston | |
| 3,883,278 A | | 5/1975 | Hass | |
| 4,418,671 A | | 12/1983 | Kelso et al. | |
| 4,561,251 A | | 12/1985 | Moret et al. | |
| 4,649,818 A | | 3/1987 | Switall et al. | |
| 4,666,389 A | | 5/1987 | Relis et al. | |
| 4,725,220 A | | 2/1988 | Percinel et al. | |
| 4,726,221 A | | 2/1988 | Tavlarides et al. | |
| 5,198,240 A | | 3/1993 | Baxi | |
| 5,494,426 A | | 2/1996 | Ibar | |
| 5,599,566 A | * | 2/1997 | Casolari | 425/406 |
| 5,652,002 A | * | 7/1997 | Kobayashi | 264/71 |
| 5,800,752 A | | 9/1998 | Charelebois | |
| 6,027,675 A | * | 2/2000 | Cassani | 264/109 |
| 6,030,576 A | * | 2/2000 | Cassani | 264/109 |
| 6,149,844 A | * | 11/2000 | Graham | 264/257 |
| 6,231,796 B1 | * | 5/2001 | Allen | 264/72 |
| 6,372,166 B1 | * | 4/2002 | Cassani | 264/120 |

FOREIGN PATENT DOCUMENTS

| | | |
|---|---|---|
| DE | 862415 C | 1/1953 |
| DE | 862416 C | 1/1953 |
| DE | 139109 A | 12/1979 |
| DE | 4320203 A1 | 12/1994 |
| DE | 19642437 A1 | 4/1997 |
| DE | 19602536 A1 | 7/1997 |
| GB | 821282 | 10/1959 |

OTHER PUBLICATIONS

The American Heritage Dictionary, Fourth Edition, Copyright (c) 2000 by Houghton Mifflin Company. Accessed using http://www.dictionary.com, search term "discrete".*

Patent Abstracts of Japan, vol. 012, No. 478 (M–775), Dec. 14, 1988 & JP 63 199099A (Toyota Motor Corp), Aug. 17, 1988; Abstract.

Patent Abstracts of Japan, vol. 012, No. 236 (M–715), Jul. 6, 1988 & JP 63 030199A (Ishikawajima Harima Heavy Ind Co Ltd), Feb. 8, 1988; Abstract.

* cited by examiner

*Primary Examiner*—Stephen J. Lechert, Jr.
(74) *Attorney, Agent, or Firm*—Birch, Stewart, Kolasch & Birch, LLP

(57) ABSTRACT

In a method for pressing ceramic powders comprising a powder compaction stage within a mold, after exerting the powder compacting pressure the powder is subjected to close-together pressure pulses while maintaining the compacting pressure applied.

7 Claims, 7 Drawing Sheets

METHOD FOR PRESSING CERAMIC POWDERS

This application is a divisional of application Ser. No. 09/124,036, filed on Jul. 29, 1998, U.S. Pat. No. 6,305,925 the entire contents of which are hereby incorporated by reference and for which priority is claimed under 35 U.S.C. §120; and this application claims priority of Application No. RE97A000057 filed in Italy on Aug. 1, 1997 under 35 U.S.C. §119.

BACKGROUND OF THE INVENTION

Ceramic tiles are commonly formed by pressing material in powder form, of between 1% and 10% moisture content, within a mold.

This forming method is commonly known as dry forming.

The soft material is loaded into the mold by known means.

After the mold has been closed by punches operated by the pressing members, powder undergoes an initial light pressing, with consequent volume reduction, to facilitate powder deaeration.

The initial light pressing, also known as the first pressing, is followed by the deaeration stage, during which pressing is interrupted and the mold is sometimes reopened to allow the air to escape.

This is followed by the main pressing to a pressure of about 400 kg/cm$^2$, which ensures perfect powder compaction.

The main pressing generally takes place in several successive steps at increasing pressure up to a maximum pressure.

The pressing force exerted by the upper cross-member of the press is distributed over the total surface of the tiles pressed during each cycle.

It should be noted that each time reference is made to the term "pressure" in the text, this unless otherwise specified means the compacting pressure to which the powder is subjected within the forming mold.

The largest currently available presses have a capacity (pressing force) of 4000 tonnes, and during each cycle are able to press a surface area of not exceeding 10,000 cm$^2$, where, for example, they can operate a die having three impressions of 54 cm×54 cm.

Achieving powder densification sufficient to ensure good quality of the finished product as the tile size increases requires an ever increasing press pressing force, implying presses of ever greater dimensions.

The object of this patent is to increase the powder densifying effect within the tile forming mold without increasing the press pressing force.

A method for pressing ceramic powder tending to achieve the aforesaid result is known, comprising subjecting to repeated blows the press cross-member with the upper part of the mold which exerts the pressing force on the powder.

This method, described in the patent application in the name of the present applicant No. 95A000063 of Oct. 18, 1995, has the advantage over conventional static pressing that for equal pressing force exerted by the press a greater powder densification is obtained, i.e., a higher powder density.

The known method has however a certain number of drawbacks which have prevented its implementation on an industrial scale.

In this respect, the effects produced by the blows cannot in practice be kept under valid control because secondary factors intervene such as friction resistance, play between the moving parts, inertia and other phenomena, which modify the system parameters.

The impossibility of maintaining the system parameters under control has resulted in vibration being partly transmitted to the machine structure, with problems of excessive noise, loosening of members or breakages occurring.

Moreover, to be able to apply the method successfully and with easily available means, the punch and the press cross-member must be of relatively small mass and hence dimensions.

An object of the invention is therefore to eliminate the drawbacks of the known method.

The object is attained, according to the invention by subjecting a powder mass to be compacted both to a press pressing force and simultaneously to vibrations which are limited substantially to the powder mass without involving the pressing members.

This is in accordance with the pressing method of the invention.

The merits, construction and operational characteristics of the invention will be more apparent from the description given hereinafter with reference to the accompanying drawings, which show a preferred embodiment thereof.

DETAILED DESCRIPTION OF THE DRAWINGS

Figure 6:
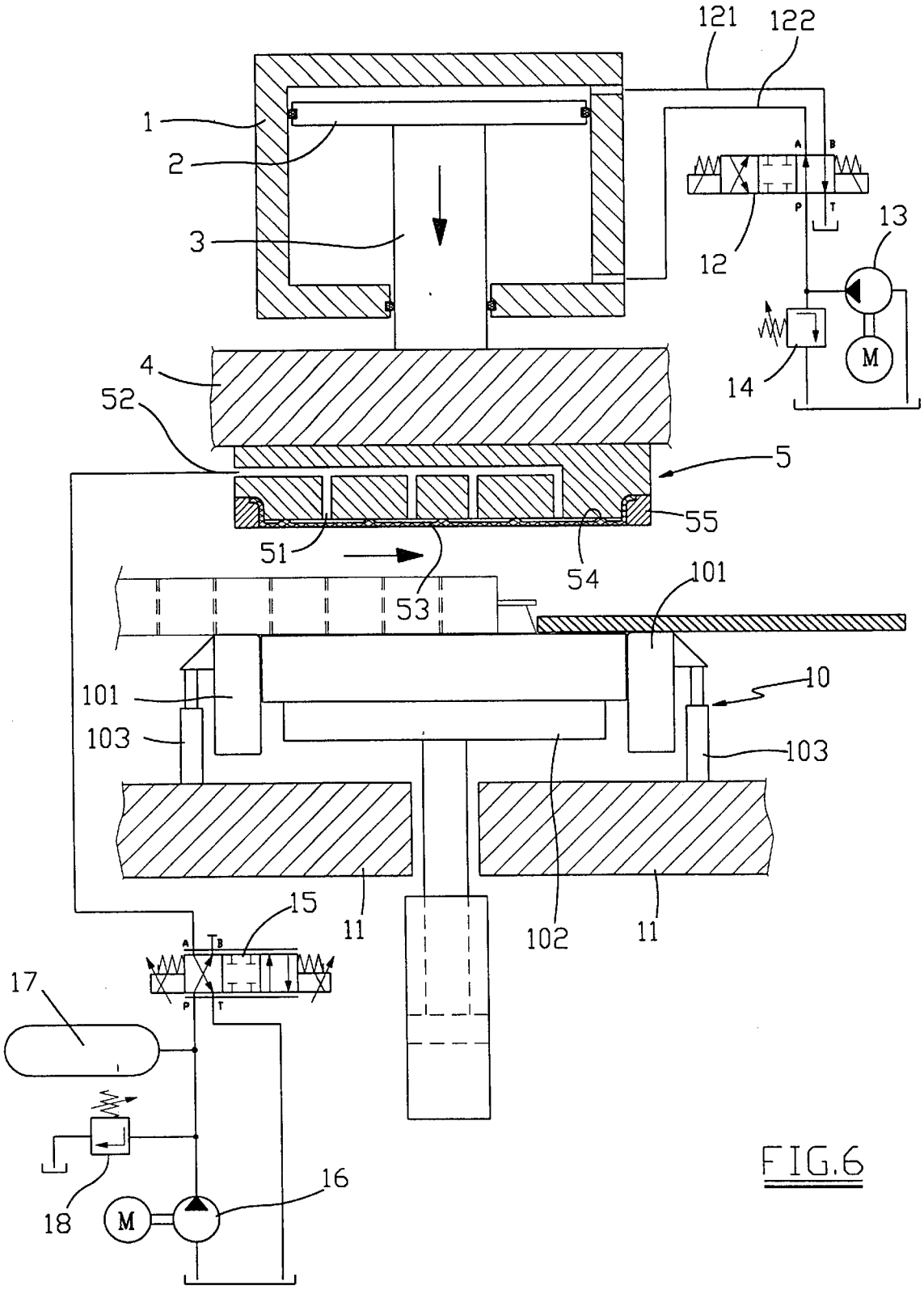
Figure 7A:
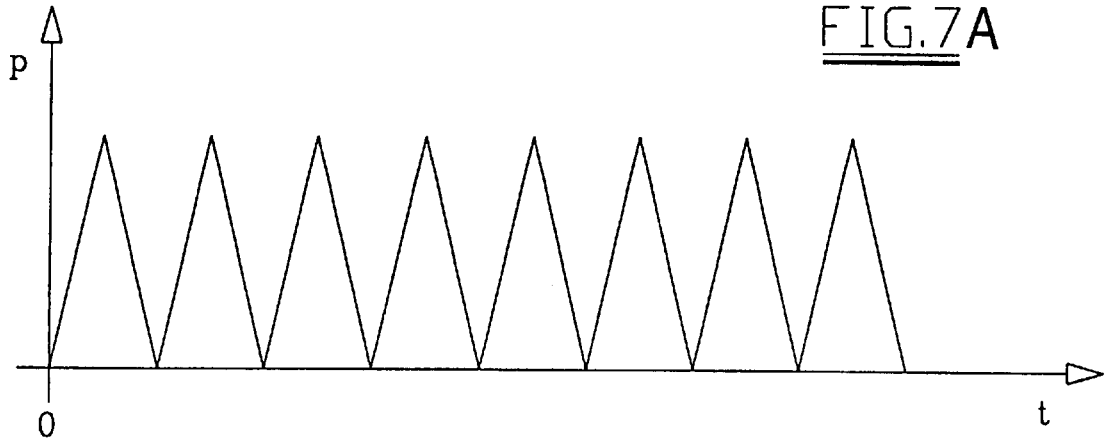
Figure 7B:
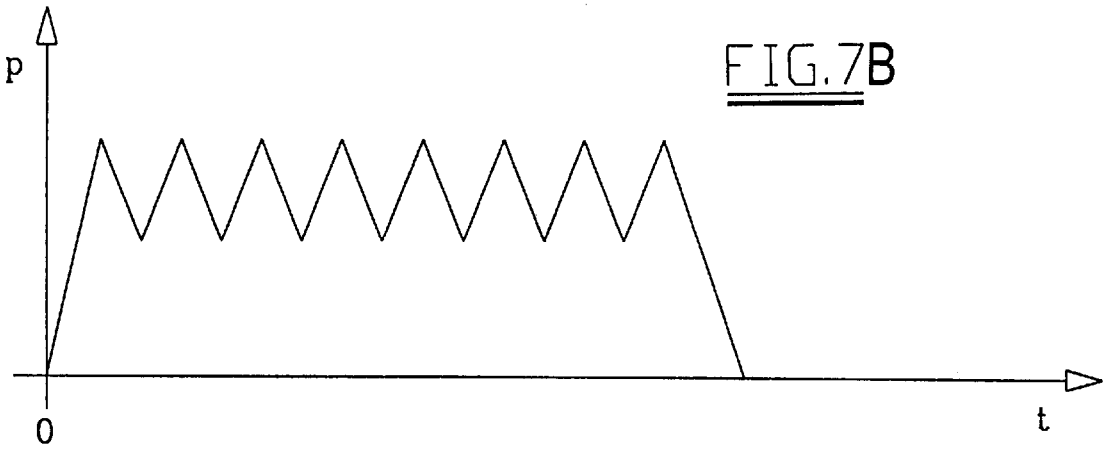
Figure 7C:
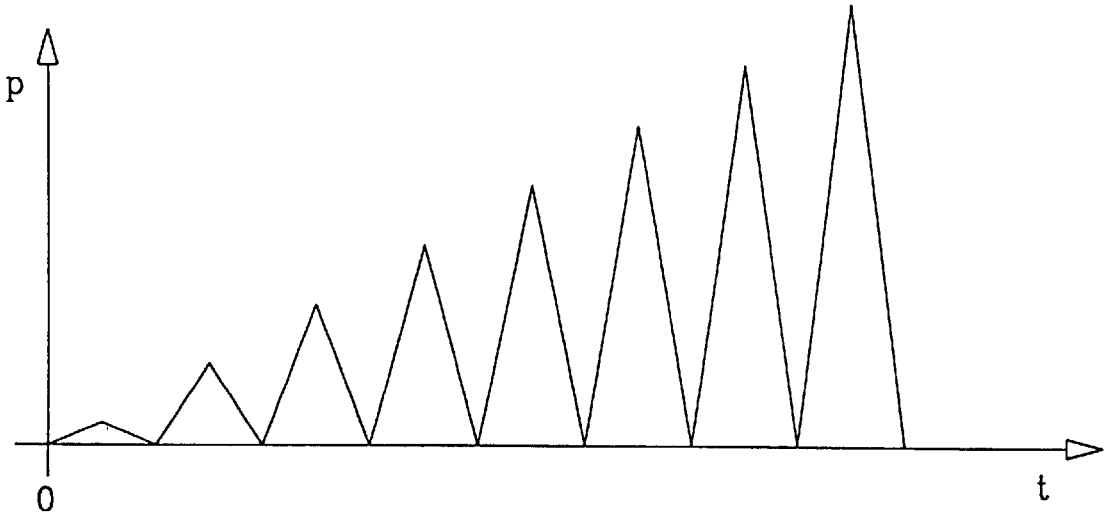

FIGS. 7A–7C, hereinafter referred to as FIG. 7, show the diagram of the pressure to which the powder is subjected within the press of FIGS. 1 to 6.

DETAILED DESCRIPTION OF THE INVENTION

FIGS. 1 to 6 show the main hydraulic press cylinder 1 within which there slides a piston 2, to the rod 3 of which the movable cross-member 4 is fixed.

The hydraulic cylinder 1 is connected above and below the piston 2 to a pressurized oil source and to the outside respectively, and vice versa, by the distributor valve 12 and the pipes 121 and 122.

Between the pressurized oil source 13 and the distributor valve 12 there is a maximum pressure valve 14.

The movable cross-member 4 lowerly carries at least one punch 5, in the interior of which there are provided channels 51 connected to a conduit which opens externally.

An elastic membrane 53 provided with support feet 54 is spread below the punch 5 and is held in position by a perimeter frame 55, the support feet maintaining the membrane slightly raised from the punch 5.

The conduit 52 is connected via a distributor valve 15 to a pressurized oil source 16 via a bidirectional shut-off valve 17 governed by the upstream and downstream pressure, and a maximum pressure valve 18.

The distributor valve 15 is controlled to feed pressurized oil pulses between the membrane 53 and the punch 5.

Below the punch 5 there is a mold 10 comprising a die 101 and a movable base 102, both supported by the press bed 11.

The mold shown is of the movable die type, with the die descending under the thrust of the punch, but could also be of any other known type.

The die 101 is supported by the pneumatic pistons 103, which act as deformable elastic means.

The initial volume of the forming cavity is defined by the level of the die 101 and by the rest position of the movable base 102 of the mold 10.

The method will now be described with reference to FIGS. 1 to 6.

After the soft material has been loaded into the cavity of the mold 10, the press cross-member is lowered until the punch 5 rests on the die to close the mold, a first light pressing then being carried out to expel air from the material to be pressed.

Figure 1:
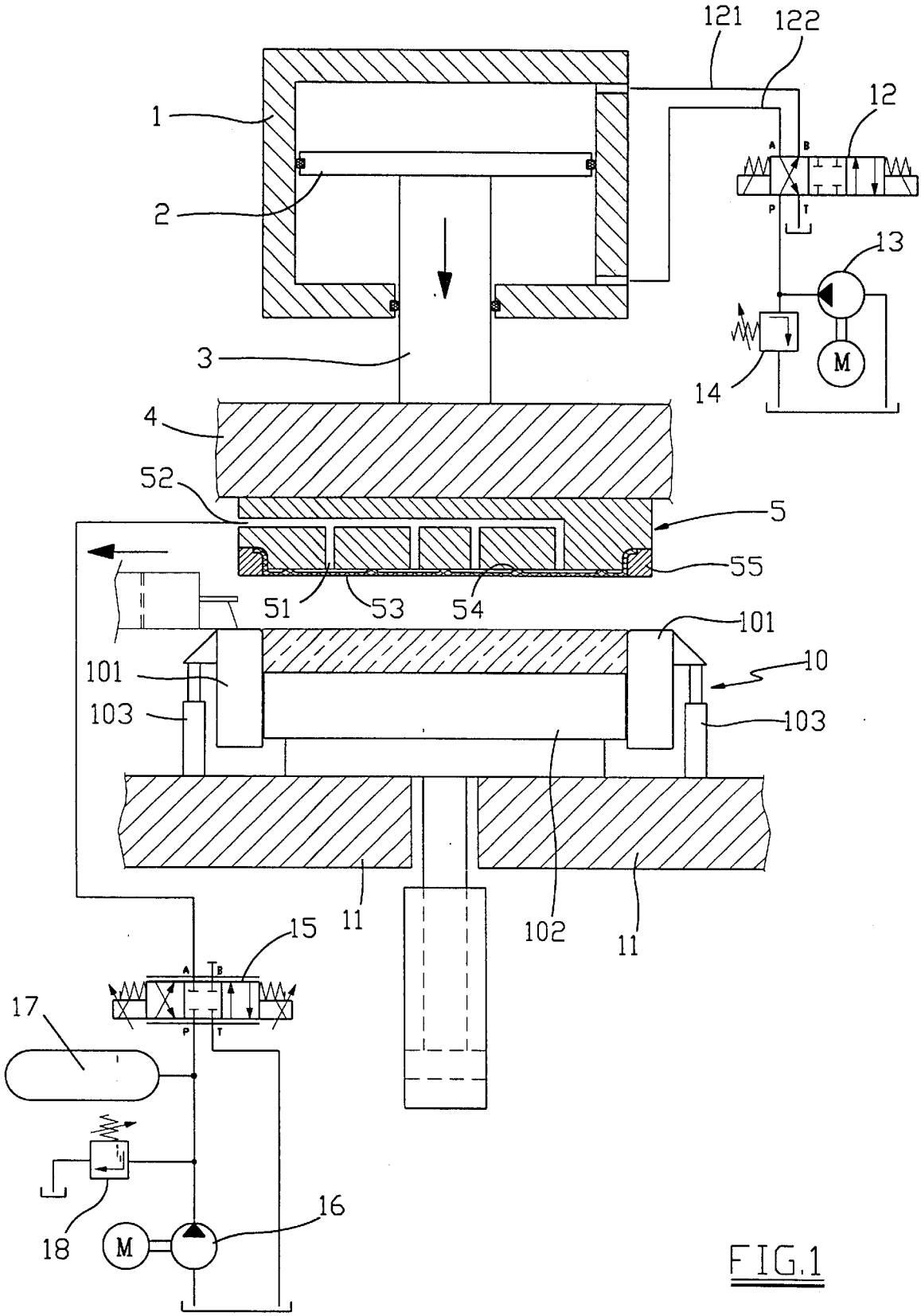
FIG. 1 is a schematic view of a ceramic press with its hydraulic operating means at the commencement of the pressing cycle according to the invention.
Figure 2:
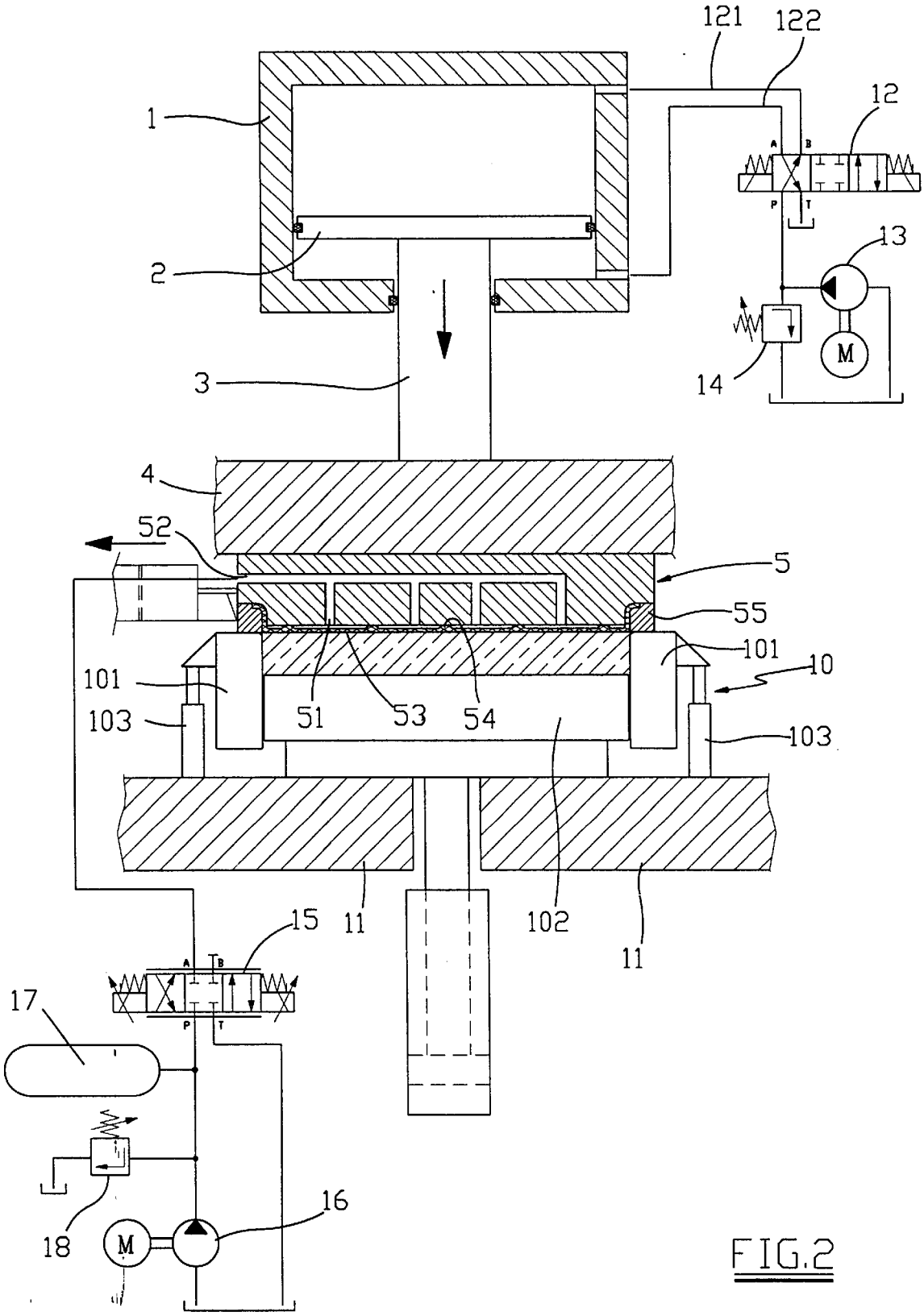
FIGS. 2 to 6 show the press of FIG. 1 in successive operating positions.

During the first pressing, the punch and the die move into the position shown in FIG. 2, the distributor valve 15 is in the configuration shown in FIGS. 1 and 2, and the space to the rear of the membrane 53 is full of oil which cannot flow out.

Figure 3:
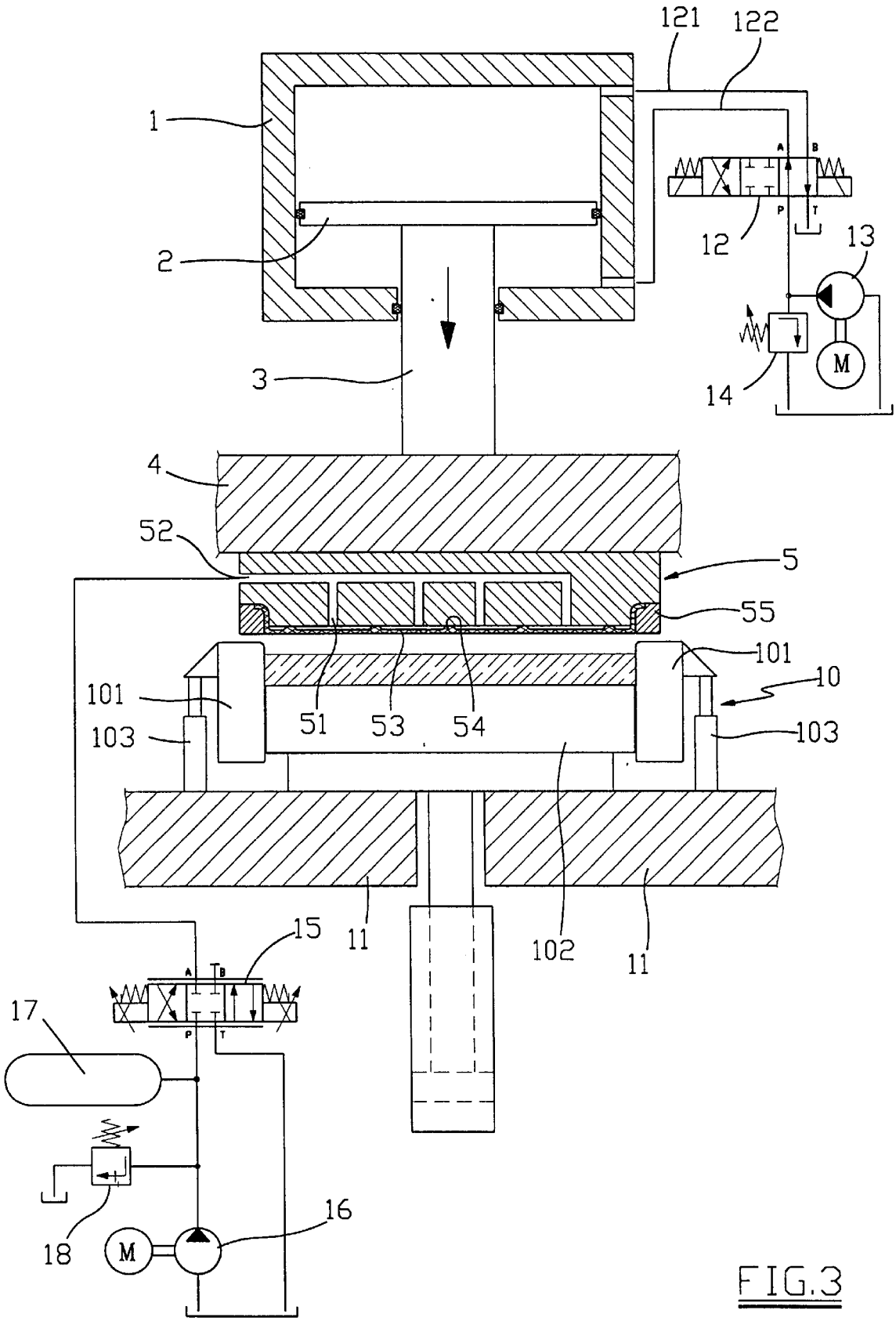

Having carried out the first deaeration pressing, the punch is slightly raised from the die into the position shown in FIG. 3.

Figure 4:
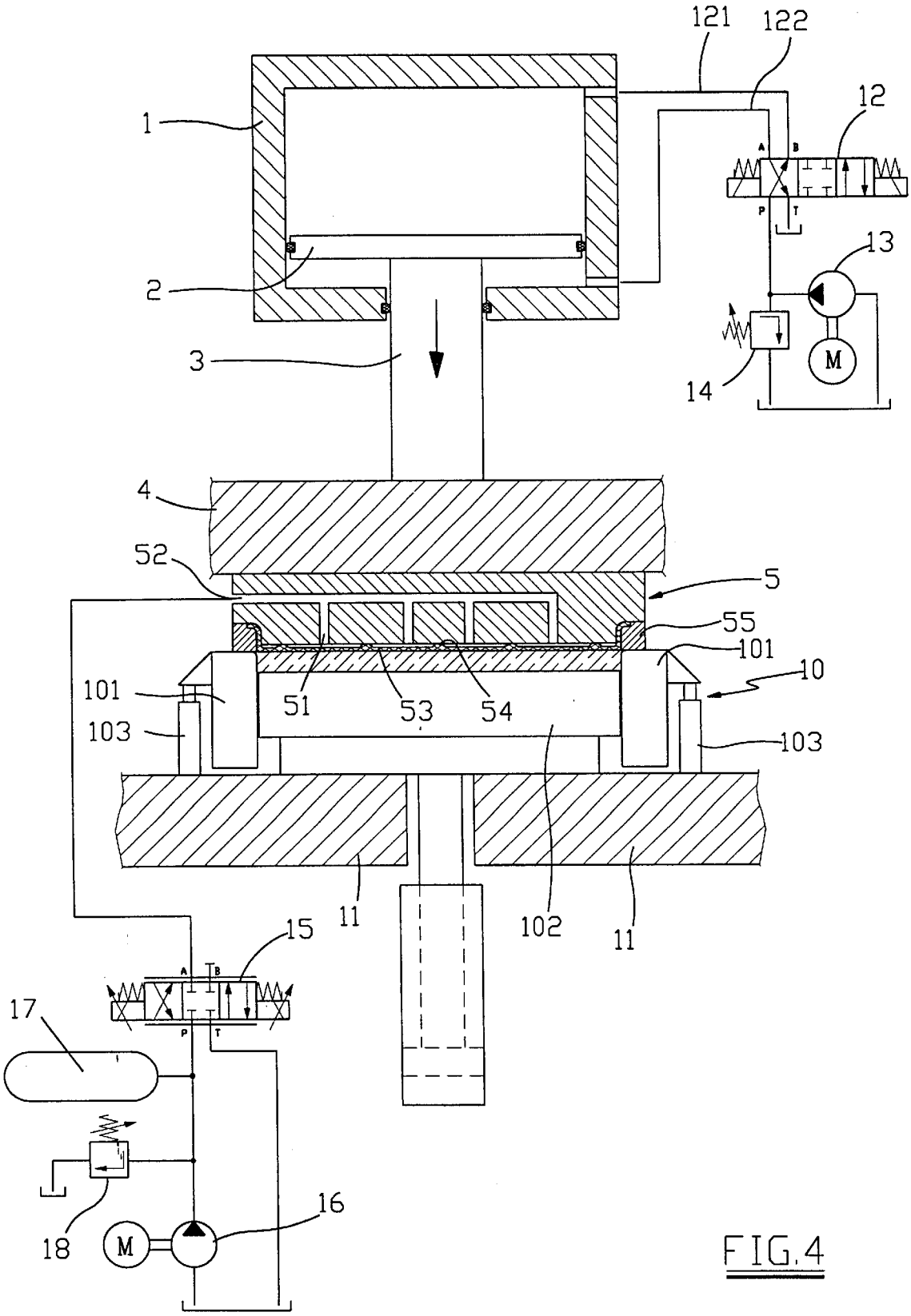
Figure 5:
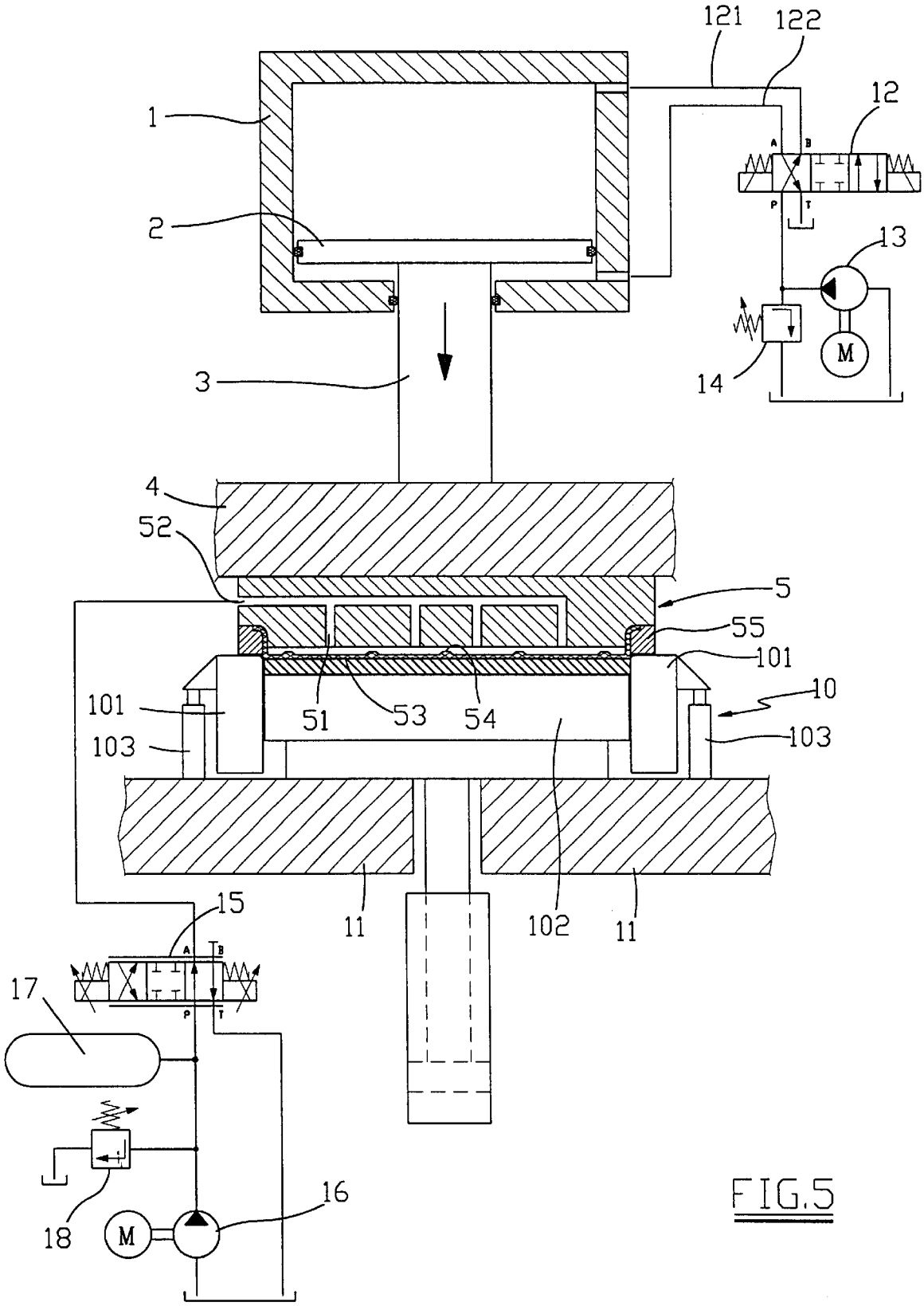

The second pressing is then carried out, in which the press assumes the configuration shown in FIG. 4.

In this configuration, the die 101 rests on the bed 11, outflow of the oil contained behind the membrane 53 still being prevented.

Then, maintaining the piston 2 descended with the distributor valve 12 positioned as in FIG. 4, a powder pulsation pressing stage is commenced during which, by suitably operating the distribution valve 15, the pressure of the oil behind the membrane 53 is made to pulsate at a frequency and amplitude regulated by the press control system.

During this stage, the pressing force exerted by the piston 2 is maintained constant, such that the piston 2 remains stationary together with the cross-member 4 and with the punch 5 resting on the bed 11 via the die 101.

The pressure pulses transmitted to the oil behind the membrane 53 have a minimum value greater than zero, and a maximum value which cannot exceed the compacting pressure corresponding to the press pressing force divided by the surface area of the mold punch or punches.

In this respect, if this value is exceeded, the maximum pressure valve operates.

Usual removal from the mold follows as shown in FIG. 6, in which the configurations of the hydraulic control circuits can also be seen.

The number of pulsations required to achieve the result is between ten and fifty pulsations per cycle, after which the densifying effect deriving from the pulsations does not substantially increase because of saturation.

The densifying effect of the pulsations increases with increasing pressing force applied to the punch and increasing liquid pressure on the rear of the membrane.

The densifying effect is greater as the maximum pulsation pressure increases.

Considering, for example, a pulsating pressing cycle at 200 bar, a considerable density increase is noted. With 8 pulsations, the same density as a standard cycle at 300 bar is obtained (50% increase in the equivalent static pressing force), and with 16 pulsations, the same effect is obtained as a standard 350 bar cycle (75% increase in the equivalent static pressing force).

An increased number of pulsations obviously results in a longer press cycle time, with reduced productivity. In contrast, achieving high densities with lower pressures allows production to be increased (in terms of maximum pressable surface area) for the same press.

The described example of the method of the invention is subject to numerous modifications.

The pulsating cycle can vary in terms of pulse frequency, number, intensity and pressure waveform, which can assume one of the forms shown in FIG. 7.

Moreover, instead of applying the pulsation only during the last pressing stage, a pressure increasing towards the maximum value can be applied from the start of pressing, while at the same time gradually increasing the thrust on the movable cross-member until the maximum value is reached.

Finally, ultrasound can be applied to the oil behind the membrane.

What is claimed is:

1. A method for pressing ceramic powder within a mold cavity to form ceramic tiles, which comprises:

subjecting the powder to a compacting pressure; and subjecting the powder to close together pressure pulses while maintaining the compacting pressure, the pressure pulses having the same pressure value over a whole surface of the mold cavity, the pressure pulses being transmitted to the powder through a flexible membrane in contact with the powder and directly resting on a layer of pressurized hydraulic incompressible liquid.

2. The method according to claim 1, wherein the pressure pulses are generated in said hydraulic incompressible liquid.

3. The method according to claim 1, wherein there are a discrete number of pressure pulses.

4. The method according to claim 1, wherein the pressure pulses have a maximum value equal to the powder compacting pressure, and a minimum value greater than zero.

5. The method according to claim 1, wherein there are between about 10 and 50 pressure pulses.

6. The method according to claim 1, wherein the hydraulic incompressible liquid is an oil.

7. The method according to claim 1, wherein the pressure pulses can have variable pulse frequency, number, intensity or pressure waveform.

* * * * *

UNITED STATES PATENT AND TRADEMARK OFFICE

CERTIFICATE OF CORRECTION

PATENT NO. : 6,558,593 B2
DATED : May 6, 2003
INVENTOR(S) : Giuseppe Cassani

It is certified that error appears in the above-identified patent and that said Letters Patent is hereby corrected as shown below:

Title page, Item [54] and Column 1, line 1,
Correct the title to read -- METHOD FOR FORMING DENSIFIED CERAMIC COMPOSITE BY MEANS OF PRESSURE PULSES --.

Signed and Sealed this

Thirtieth Day of December, 2003

JAMES E. ROGAN
*Director of the United States Patent and Trademark Office*